US009578953B2

(12) United States Patent
Chueh

(10) Patent No.: US 9,578,953 B2
(45) Date of Patent: Feb. 28, 2017

(54) BACKPACK WITH MULTIPLE CONNECTED AIRBAGS

(71) Applicant: Bagmaster International Company Limited, Taipei (TW)

(72) Inventor: Ho-Jen Chueh, Taipei (TW)

(73) Assignee: Bagmaster International Company Limited, Taipei (TW)

( * ) Notice: Subject to any disclaimer, the term of this patent is extended or adjusted under 35 U.S.C. 154(b) by 0 days.

(21) Appl. No.: 14/735,236

(22) Filed: Jun. 10, 2015

(65) Prior Publication Data

US 2016/0235186 A1 Aug. 18, 2016

(30) Foreign Application Priority Data

Feb. 17, 2015 (TW) ..... 104105496 A

(51) Int. Cl.
*A45F 3/04* (2006.01)
*A45F 3/12* (2006.01)

(52) U.S. Cl.
CPC ..... *A45F 3/04* (2013.01); *A45F 2003/122* (2013.01)

(58) Field of Classification Search
CPC ..... A45F 3/04; A45F 3/12; A45F 3/16; A45F 13/30; A45F 2003/166; A45F 2003/122
USPC ..... 224/643, 644, 265, 907; 441/111
See application file for complete search history.

(56) References Cited

U.S. PATENT DOCUMENTS 900,610 A * 10/1908 Stow ..... A45F 3/12 2/460
1,444,157 A * 2/1923 Lee ..... A45F 3/04 224/264
3,679,108 A * 7/1972 Ingram ..... A45F 3/04 224/644
3,964,266 A * 6/1976 Bartlett ..... B63C 11/2245 114/315
4,750,654 A * 6/1988 Menetrier ..... A45F 3/04 224/262
5,320,262 A * 6/1994 Levis ..... A45F 3/04 224/261
5,400,934 A * 3/1995 Ducros ..... A45F 3/04 128/202.15
5,547,461 A * 8/1996 Levis ..... A45F 3/04 128/876
5,577,648 A * 11/1996 Sason ..... A45F 3/047 224/264
5,722,573 A * 3/1998 Carnel ..... A45F 3/16 224/148.2

(Continued)

*Primary Examiner* — Peter Helvey

(57) ABSTRACT

A backpack with multiple connected airbags includes a backpack body, a first airbag unit, and at least an air inlet. The backpack body has a set of straps. The first airbag unit includes a plurality of first airbags and is connected to the rear side of the backpack body. A groove and an air channel are formed between each two adjacent first airbags. The air channels allow the air in the first airbags to flow between the first airbags. The first airbags are so arranged that each first airbag in the peripheral region of the first airbag unit occupies a larger area on the rear side of the backpack body than any first airbag in the central region. The air inlet is in communication with at least one first airbag. The backpack can lie compliantly against the user's back to provide enhanced comfort and stability while protecting the user's spine.

19 Claims, 11 Drawing Sheets

(56) References Cited

U.S. PATENT DOCUMENTS

| | | | | | |
|---|---|---|---|---|---|
| 5,901,889 | A * | 5/1999 | Ho | A45F 3/16 | 128/DIG. 26 |
| 5,957,356 | A * | 9/1999 | Potempa | A45C 7/0081 | 224/259 |
| 5,975,387 | A * | 11/1999 | Gleason | A45F 3/047 | 224/148.2 |
| 6,109,495 | A * | 8/2000 | Hernandez | A45F 3/04 | 224/264 |
| 6,168,056 | B1 * | 1/2001 | Bertholon | A45C 13/30 | 224/264 |
| 6,173,671 | B1 * | 1/2001 | Casull | B63B 7/082 | 114/345 |
| 6,471,105 | B1 * | 10/2002 | Ammerman | A45C 13/30 | 150/110 |
| 6,527,480 | B2 * | 3/2003 | Angelini | B63C 11/30 | 405/186 |
| 6,793,112 | B2 * | 9/2004 | Ammerman | A45F 3/02 | 224/257 |
| 6,820,783 | B2 * | 11/2004 | Beale | A45F 3/04 | 224/642 |
| 6,863,202 | B2 * | 3/2005 | Ammerman | A45C 13/30 | 150/110 |
| 7,631,792 | B2 * | 12/2009 | Christy | A45F 3/04 | 224/642 |
| 7,717,310 | B2 * | 5/2010 | Zalinsky | A45F 3/12 | 224/261 |
| 2002/0074374 | A1 * | 6/2002 | Holbl | A45F 3/04 | 224/644 |
| 2002/0158097 | A1 * | 10/2002 | Beale | A45F 3/04 | 224/644 |

* cited by examiner

BACKPACK WITH MULTIPLE CONNECTED AIRBAGS

BACKGROUND OF THE INVENTION

1. Technical Field

The present invention relates to a backpack with multiple connected airbags and, more particularly, to a backpack having multiple connected airbags and designed for use as a school bag or to be carried on the user's back while the user is hiking or travelling.

2. Description of Related Art

With the rapid growth of economy, people nowadays have attached more and more importance to recreation and the maintenance of health. Because of that, recreational activities such as travelling and hiking have become increasingly popular. During such activities, a backpack is typically used to carry personal belongings or related equipment, but carrying a backpack on the back for a long time can be a burden on not only the skin of the back but also the spine. It is also necessary for one who carries a backpack on the back to adjust their body posture frequently in response to topographical conditions. Therefore, comfort and stability are two major features to look for when choosing a backpack.

Some of the conventional backpacks have shown improvement in breathability, heat dissipation, and/or comfort. For example, a small number of large soft pads are provided on the rear side of a backpack at positions to be in contact with the user's back. These pads add to the user's comfort while the grooves between the pads facilitate ventilation as well as the dissipation of sweat and heat from the skin of the user's back. Nevertheless, the few pads, made generally of foam or like materials, form only a small number of grooves between them and put more weight on the backpack. In consequence, the intended ventilation and heat dissipation effects are limited, and the burden on the user's back is increased. Besides, the few but large pads tend to prevent the backpack from being adjusted in shape in accordance with the user's posture and movement, thus compromising the comfort and stability of the backpack.

To reduce the weight attributable to the pads, some backpacks use airbags instead of foam pads. While this alternative design does reduce the overall weight of the backpack, the airbags are still small in number but large in size such that the heat dissipation and ventilation problems remain. The airbags also fail to provide improvement in comfort and stability while the backpack user is moving.

It is therefore a pressing issue in the backpack industry to solve the aforesaid problems effectively.

BRIEF SUMMARY OF THE INVENTION

The present invention aims to overcome the drawbacks of the conventional backpacks, namely their uncomfortableness and poor stability when carried on the back due to failure to lie compliantly against the user's back all the time, the hindrance they cause to ventilation and heat dissipation from the user's back because of the large area of close contact with the user's back, and the load they add to, and lack of protection for, the user's spine.

The present invention provides a backpack having multiple connected airbags, wherein the backpack includes a backpack body, a first airbag unit, and at least an air inlet. The backpack body has a set of straps. The first airbag unit includes a plurality of first airbags and is connected to the rear side of the backpack body. A groove and an air channel are formed between each two adjacent first airbags. The air channels allow the air in the first airbags to flow between the first airbags. The first airbags are so arranged that each first airbag in the peripheral region of the first airbag unit occupies a larger area on the rear side of the backpack body than any first airbag in the central region of the first airbag unit. The air inlet is in communication with at least one of the first airbags.

Implementation of the present invention at least involves the following inventive steps:

1. The backpack can lie compliantly against the user's back to offer enhanced comfort and stability.

2. When carried on the back, the backpack do not put additional load on, and can therefore protect, the user's spine.

The detailed features and advantages of the present invention will be described in detail with reference to the preferred embodiments so as to enable persons skilled in the art to gain insight into the technical disclosure of the present invention, implement the present invention accordingly, and readily understand the objectives and advantages of the present invention by perusal of the contents disclosed in the specification, the claims, and the accompanying drawings.

DETAILED DESCRIPTION OF THE INVENTION

Figure 1A:
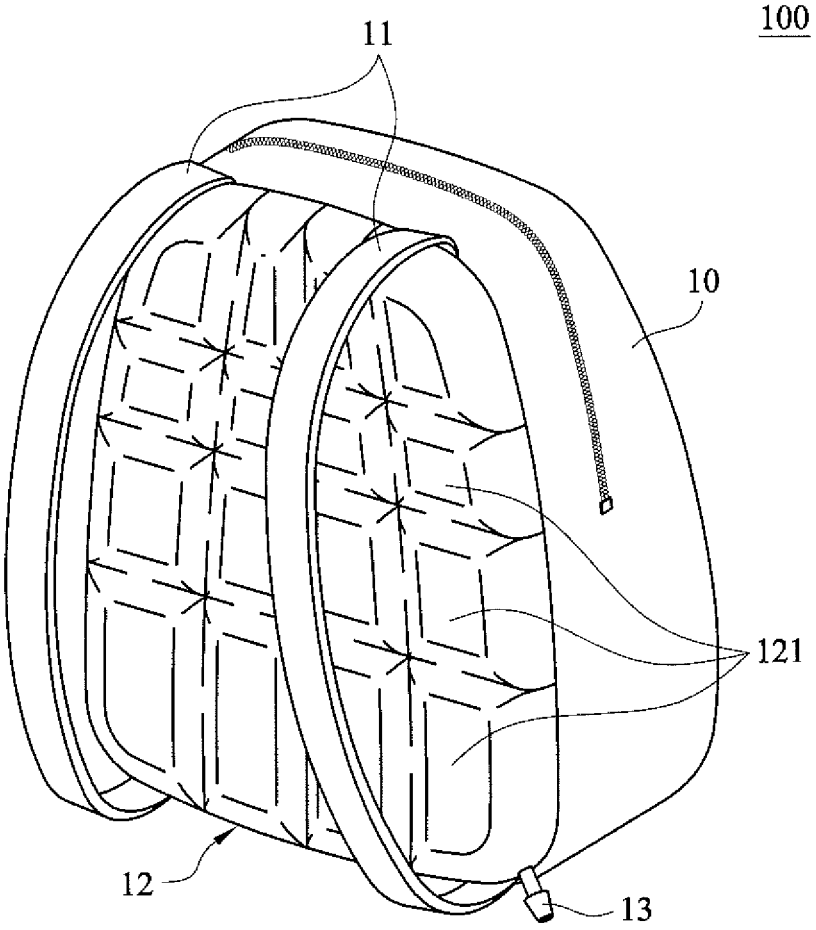
FIG. 1A is a perspective view of the backpack with multiple connected airbags in an embodiment of the present invention.

Referring to FIG. 1A, the backpack 100 with multiple connected airbags in an embodiment of the present invention includes a backpack body 10, a first airbag unit 12, and an air inlet 13.

The backpack body 10 provides a space for receiving the objects the user puts in it. The backpack body 10 also serves as a frame to which the other components can be attached. The backpack body 10 has a set of straps 11 which allow the backpack 100 to be carried on the user's back and which consequently carry the weight of the backpack 100 and its contents.

The first airbag unit 12 includes a plurality of first airbags 121 and is connected to the rear side of the backpack body 10, i.e., the side of the backpack body 10 that is close to the user's back when the backpack 100 is carried on the back. The first airbags 121 in the first airbag unit 12 form a cushion between the backpack body 10 and the user's back so that the backpack 100 can provide a comfortable feel when carried on the back.

Figure 1B:
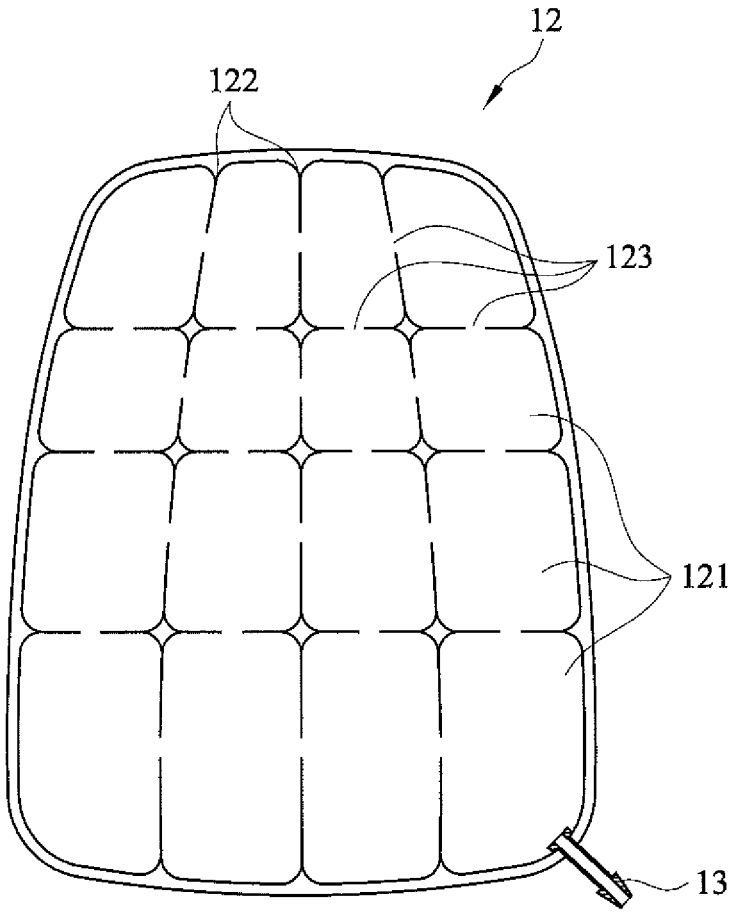
FIG. 1B schematically shows how the first airbags in the embodiment of FIG. 1A can be arranged.

Referring to FIG. 1B, each first airbag 121 is an air-containing space with borders on all sides, so a groove 122 is formed between each two adjacent first airbags 121. These grooves 122 provide a plurality of furrows between the first airbag unit 12 and the user's back through which air can flow and through which, therefore, the heat and moisture discharged from the user's back can dissipate. Thus, inefficient dissipation of heat and sweat a problem commonly seen in the conventional backpacks with only a small number of large soft pads is overcome.

When the user bends or turns his or her body, the first airbag unit 12 bends at those grooves 122 that correspond in position to the body portion being bent or turned. This allows the entire first airbag unit 12 to lie compliantly against the user's back while the user is moving, thereby increasing the comfort and stability of the backpack 100 on the back.

In addition, an air channel 123 is formed between each two adjacent first airbags 121, and the air channels 123 allow the air in the first airbags 121 to flow between the first airbags 121. Thanks to this structural feature, each first airbag 121 can adjust its shape when the contour of the user's back is changed by the user's body movement, for the air in certain first airbags 121 will increase while the air in other first airbags 121 decreases due to the air flow therebetween. This allows the entire first airbag unit 12 to lie even more compliantly against the user's back such that the comfort and stability of the backpack 100 are further enhanced.

As to the arrangement of the first airbags 121, it is so designed that each first airbag 121 in the peripheral region of the first airbag unit 12 occupies a larger area on the rear side of the backpack body 10 than any first airbag 121 in the central region of the first airbag unit 12. The relatively large first airbags 121 in the peripheral region provide stronger support than the relatively small ones in the central region and reinforce the entire backpack 100 by forming a frame-like structure.

The first airbags 121 in the central region of the first airbag unit 12 correspond to the middle section of the human back, i.e., the section where the spine tends to bend frequently. As the grooves 122 of the relatively small first airbags 121 are arranged in a relatively dense manner, this part of the first airbag unit 12 can change and adjust its shape more subtly, allowing the backpack 100 to conform to the curve of the user's back while the user is moving. This not only adds to the comfort and stability of the backpack 100, but also provides protection for the user's spine.

The first airbags 121 in this embodiment can be shaped and arranged in many different ways. For instance, the first airbags 121 in the first airbag unit 12 can be generally rectangular and arranged in the form of a matrix.

Alternatively, referring to FIG. IC, the first airbags 121 may be shaped and arranged according to the body portions to which they correspond respectively, provided that each first airbag 121 in the peripheral region of the first airbag unit 12 occupies a larger area on the rear side of the backpack body 10 than any first airbag 121 in the central region. Thus, more comfortable arrangements of the first airbags 121 can be achieved, in order for the first airbag unit 12 to provide various protective effects on the user's spine.

Figure 1C:
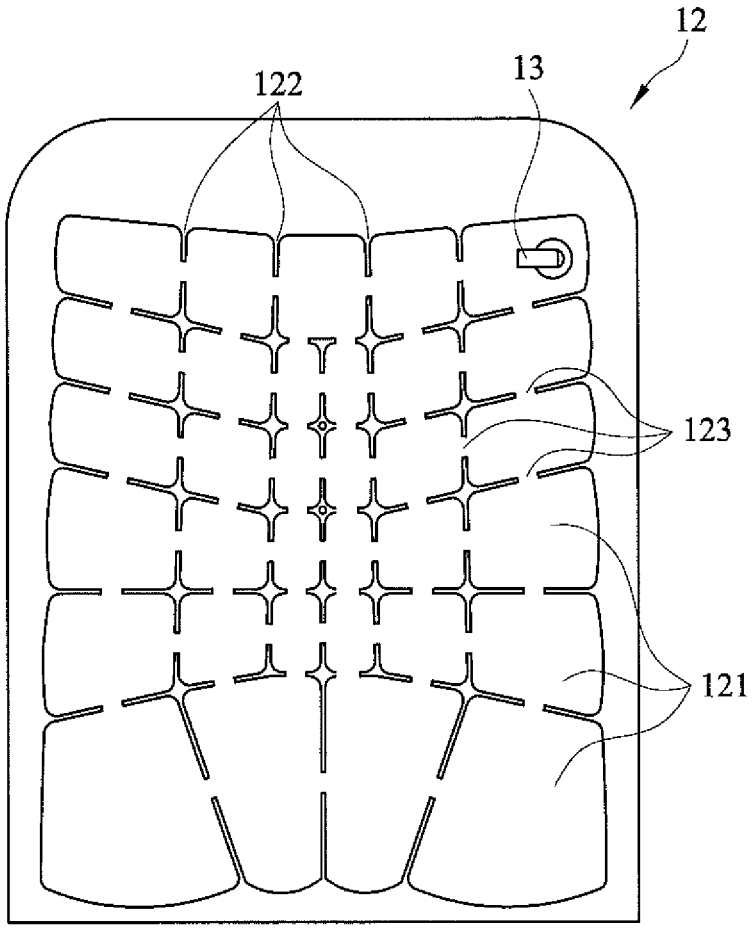
FIG. 1C schematically shows another arrangement of the first airbags in the embodiment of FIG. 1A.
Figure 1D:
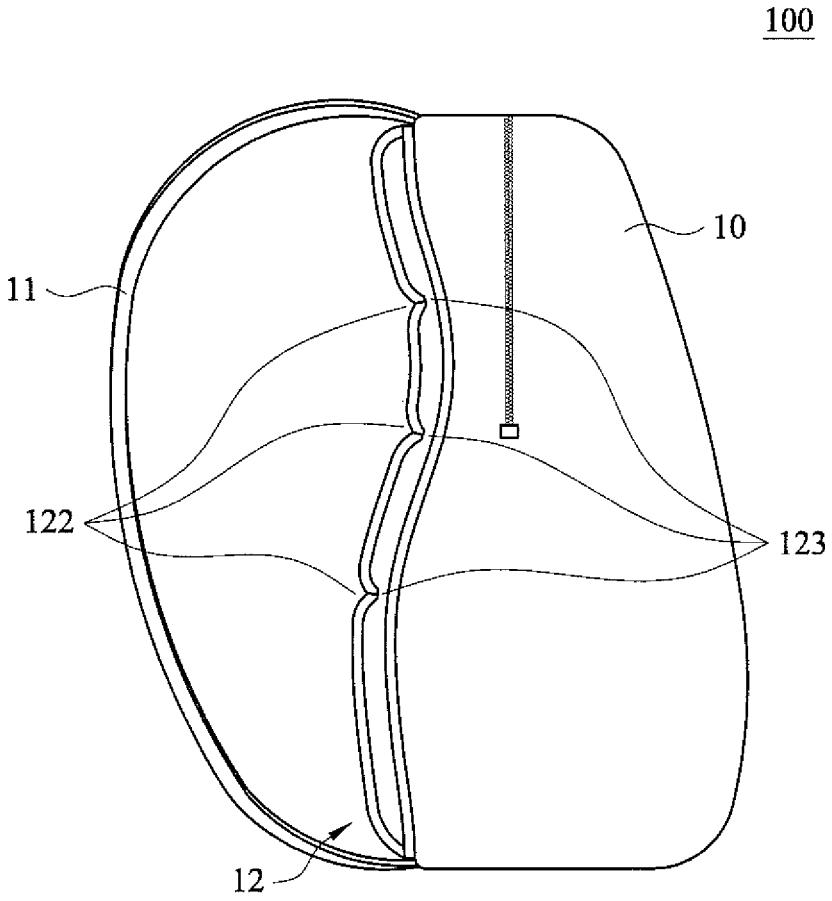
FIG. 1D is a side view of the backpack in another embodiment of the present invention.

In addition to being arranged on a plane, the first airbags 121 in the first airbag unit 12 can be arranged along an ergonomic curve as shown in the side view of FIG. 1D. By doing so, the backpack 100 is rendered more comfortable, more supportive, and more protective of the user's spine. For example, the first airbags 121 can be so arranged that the upper half of them cave in toward the inside of the backpack 100 while the lower half of them project outward of the backpack 100; in that case, the first airbag unit 12 forms an S-shaped curved when viewed from the side.

Figure 1E:
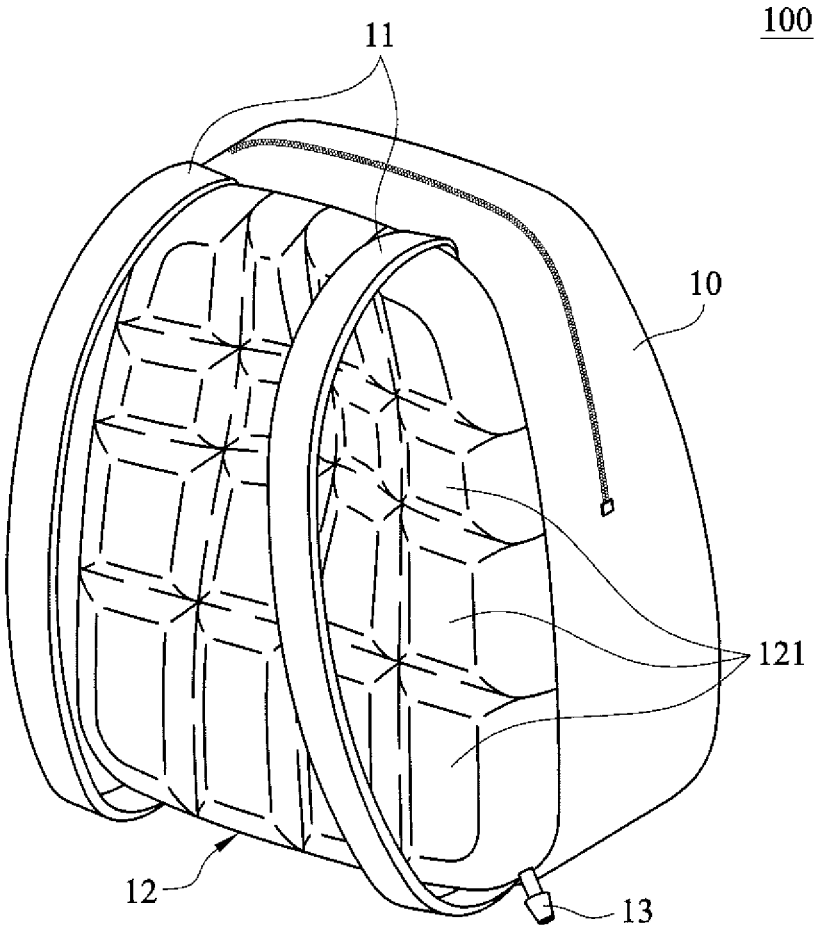
FIG. 1E is a perspective view of the backpack in yet another embodiment of the present invention.

Referring to FIG. 1E, the first airbags 121 may also be arranged in such a way that the first airbag unit 12 is curved when viewed from the top. For example, the first airbags 121 on the left and right sides of the vertical centerline of the rear side of the backpack body 10 cave in slightly toward each other and toward the inside of the backpack 100 to form a curve that conforms to the contour of the human back, or more particularly to a transverse contour in which the central spinal portion is slightly raised with respect to the two lateral sides. This arrangement of the first airbags 121 features additional comfort and provides better protection for the user's spine by lowering the pressure applied by the entire backpack 100 to a portion of the spine.

Referring back to FIG. 1A to FIG. 1C, the backpack 100 has at least one air inlet 13, and each air inlet 13 is in communication with at least one first airbag 121. As each two adjacent first airbags 121 of the first airbag unit 12 can communicate with each other through the air channel 123 therebetween, the entire first airbag unit 12 can be inflated and deflated via any of the at least one air inlet 13. Not only can the first airbag unit 12 be reinflated when leakage of air has occurred, but also the hardness/softness of the first airbag unit 12 can be adjusted to meet the user's needs or preference so that the backpack 100 feels more comfortable or more secured on the back.

Figure 1F:
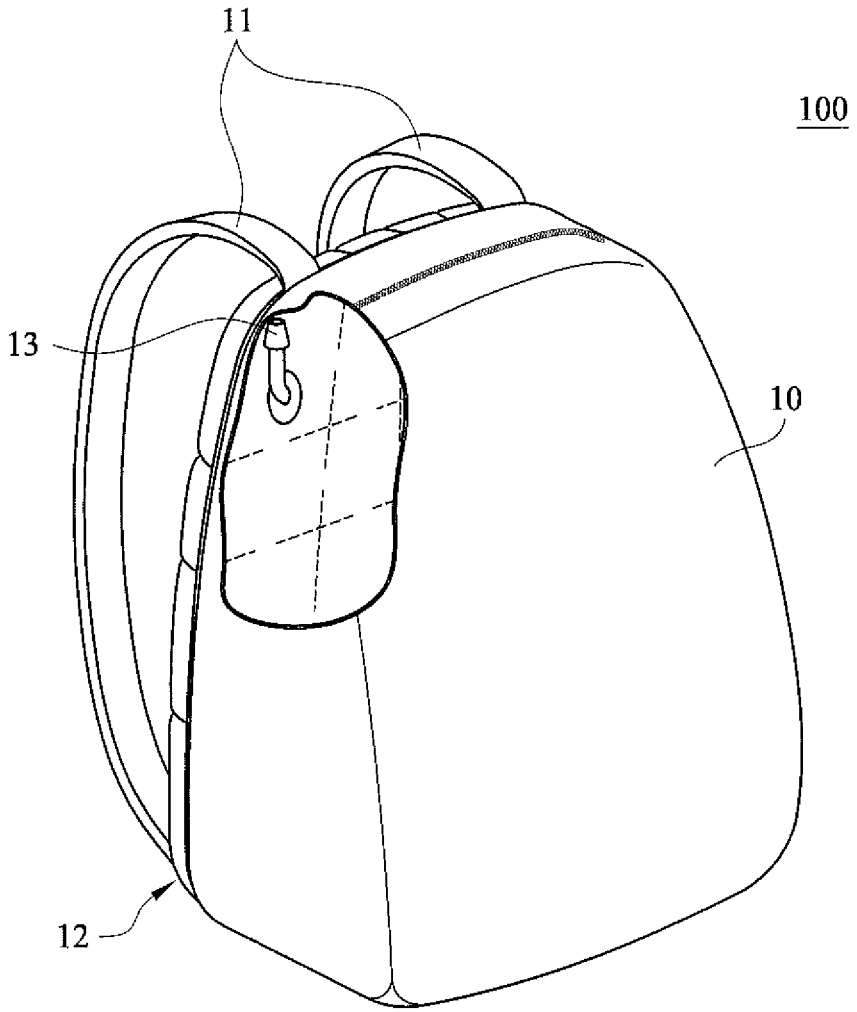
FIG. 1F is a cutaway view of the backpack in still another embodiment of the present invention, wherein the air inlet is located inside the backpack.

Referring to FIG. 1F, the air inlet 13 can be provided inside rather than outside the backpack 100 just as well. Since all the first airbags 121 of the first airbag unit 12 are in communication with one another, the air inlet 13 can be provided anywhere on the backpack 100 and is still able to be used to inflate and deflate the entire first airbag unit 12 provided that the air inlet 13 is in communication with one of the first airbags 121.

Figure 2:
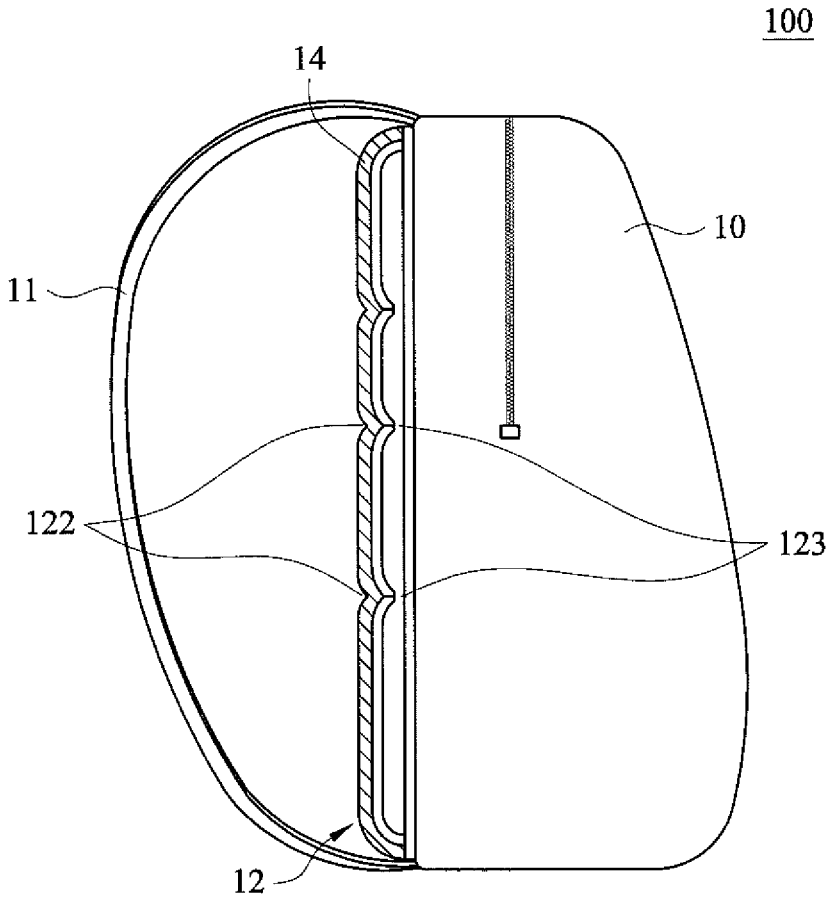
FIG. 2 is a side view of the backpack in a further embodiment of the present invention, wherein the first airbag unit is connected with a breathable and waterproof fabric as its outermost layer.

FIG. 2 shows an embodiment of the present invention in which the backpack with multiple connected airbags has a breathable and waterproof (i.e., water-vapor permeable and liquid-water impermeable) fabric 14 connected to and serving as the outermost layer of the first airbag unit 12. The breathable and waterproof fabric 14 is provided so that the skin areas of the user's back that do not correspond in position to the grooves 122 between the first airbags 121 can dissipate heat into the ambient air through the breathable and waterproof fabric 14, allowing the user to feel dry and comfortable on the back.

Figure 3:
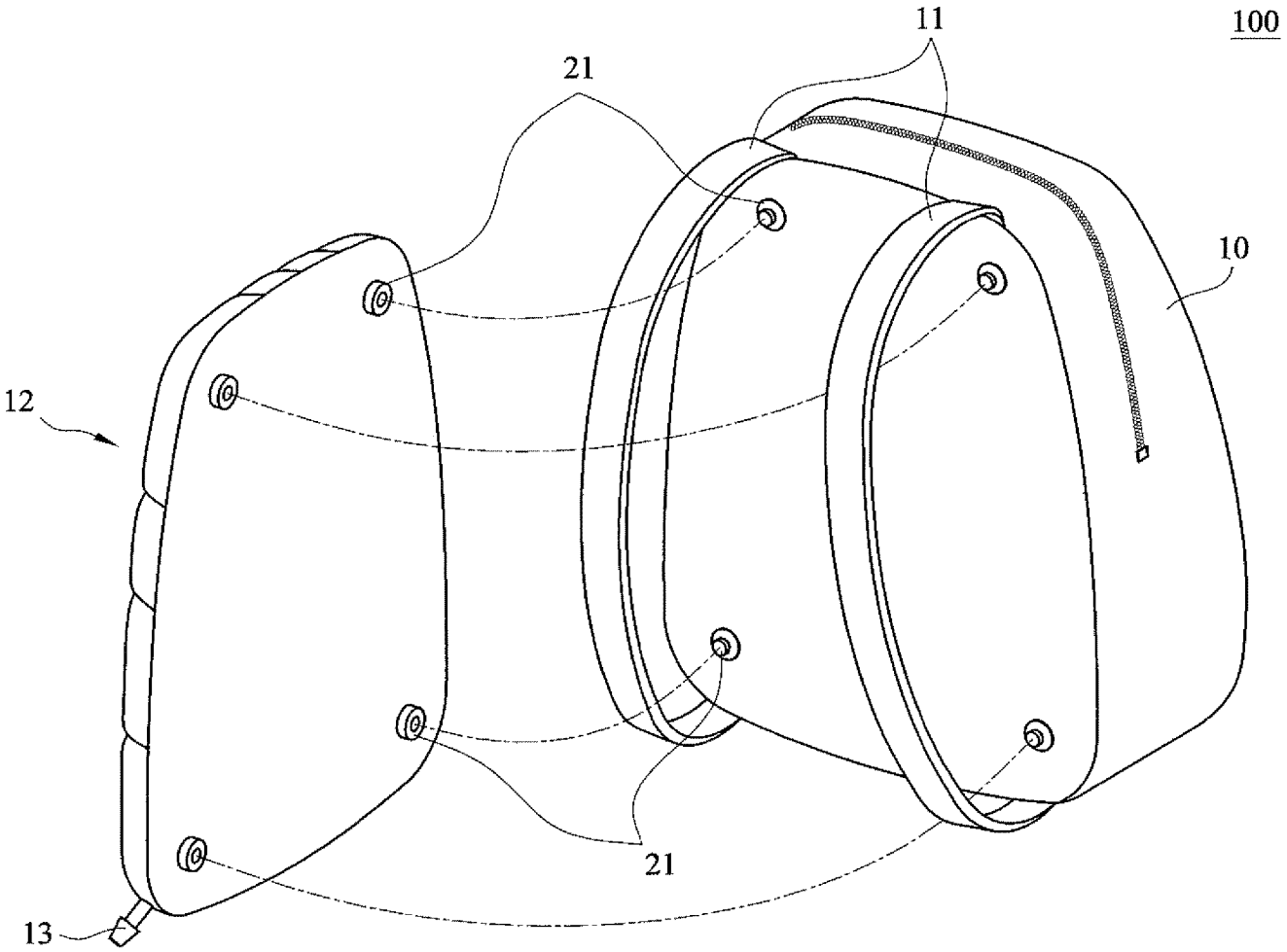
FIG. 3 schematically shows how the first airbag unit of the backpack in an embodiment of the present invention is connected to the backpack body by snap fasteners.
Figure 4:
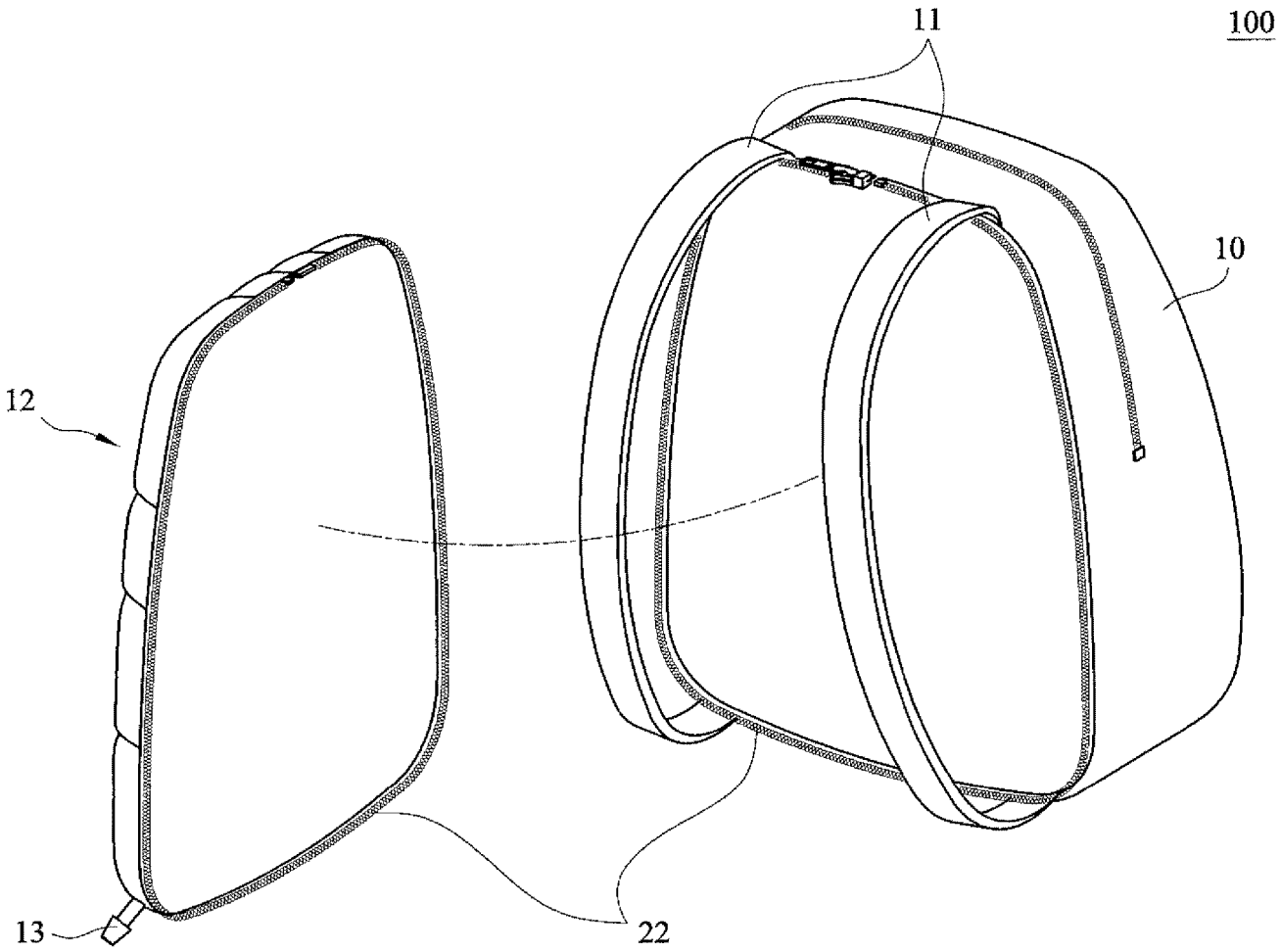
FIG. 4 schematically shows how the first airbag unit of the backpack in an embodiment of the present invention is connected to the backpack body by a zipper.
Figure 5:
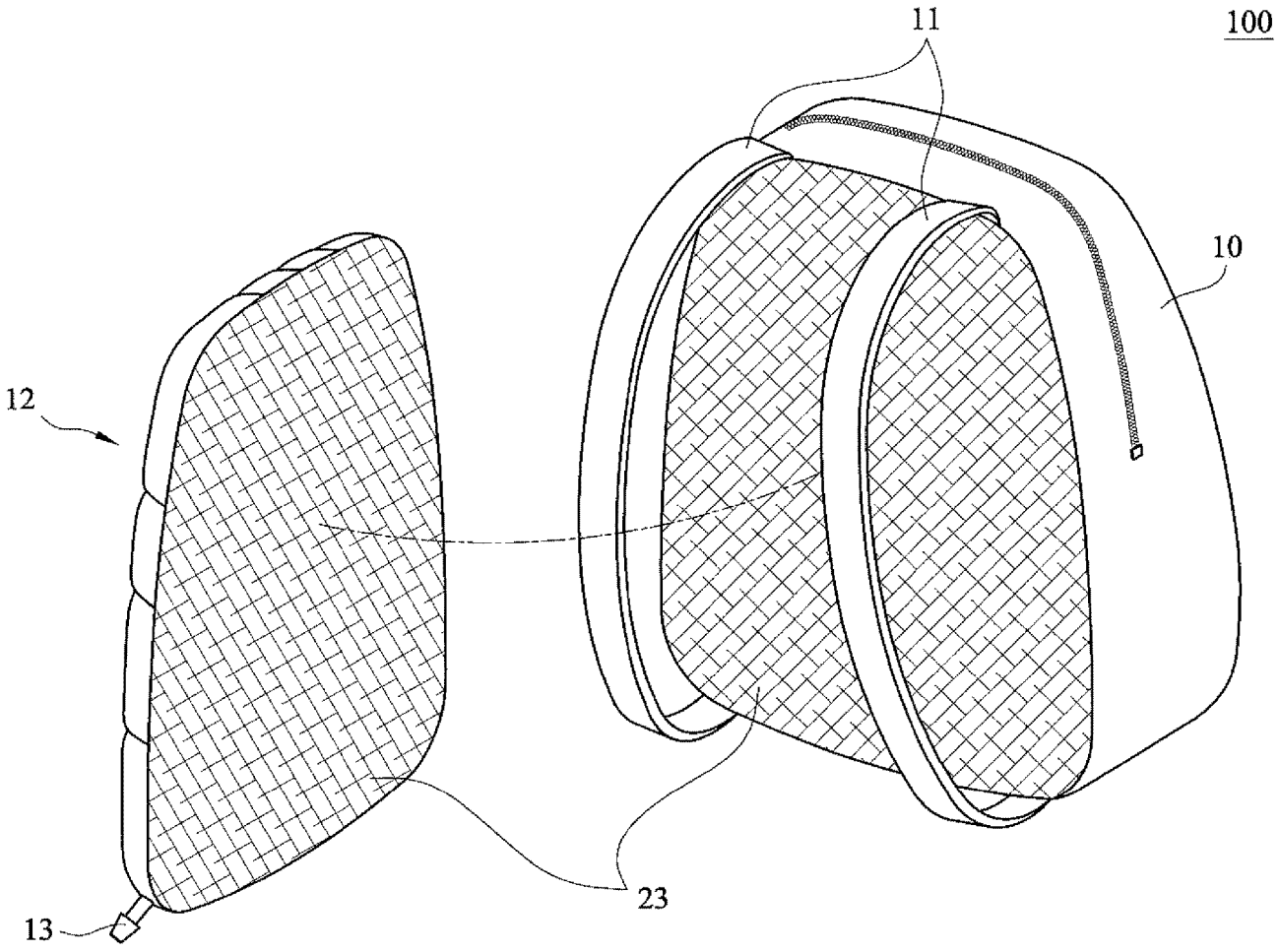
FIG. 5 schematically shows how the first airbag unit of the backpack in an embodiment of the present invention is connected to the backpack body by a Velcro fastener.

Referring to FIG. 3 to FIG. 5, the first airbag unit 12 not only can be fixedly provided on the rear side of the backpack body 10, but also can be detachably connected to the backpack body 10 by a fastening means and therefore serve as a detachable component.

For instance, the fastening means for achieving detachable connection can be a plurality of snap fasteners 21 as shown in FIG. 3. Each snap fastener 21 has two portions provided respectively on the rear side of the backpack body 10 and the first airbag unit 12 at corresponding positions.

Alternatively, referring to FIG. 4, at least one zipper 22 can be used in place of the snap fasteners 21, and the two sides of the zipper 22 are provided around the rear side of the backpack body 10 and the first airbag unit 12 respectively. When only one zipper 22 is used, its two sides can be provided along a periphery of the backpack body 10 and a periphery of the first airbag unit 12 respectively. When two zippers 22 are used, they can be connected end-to-end so as to encircle the periphery of the junction between the backpack body 10 and the first airbag unit 12 in its entirety, or the two zippers 22 can be provided only at two opposite lateral edges of the backpack body 10 and first airbag unit 12.

Moreover, the fastening means for achieving detachable connection can be at least one Velcro fastener 23 as shown in FIG. 5. If only one Velcro fastener 23 is used, its two portions can be connected to and completely cover the respective connecting surfaces of the backpack body 10 and the first airbag unit 12. If a plurality of Velcro fasteners 23 are used, they can be provided in a distributed manner, with the two portions of each Velcro fastener 23 connected to the respective connecting surfaces of the backpack body 10 and the first airbag unit 12 at corresponding positions.

Figure 6:
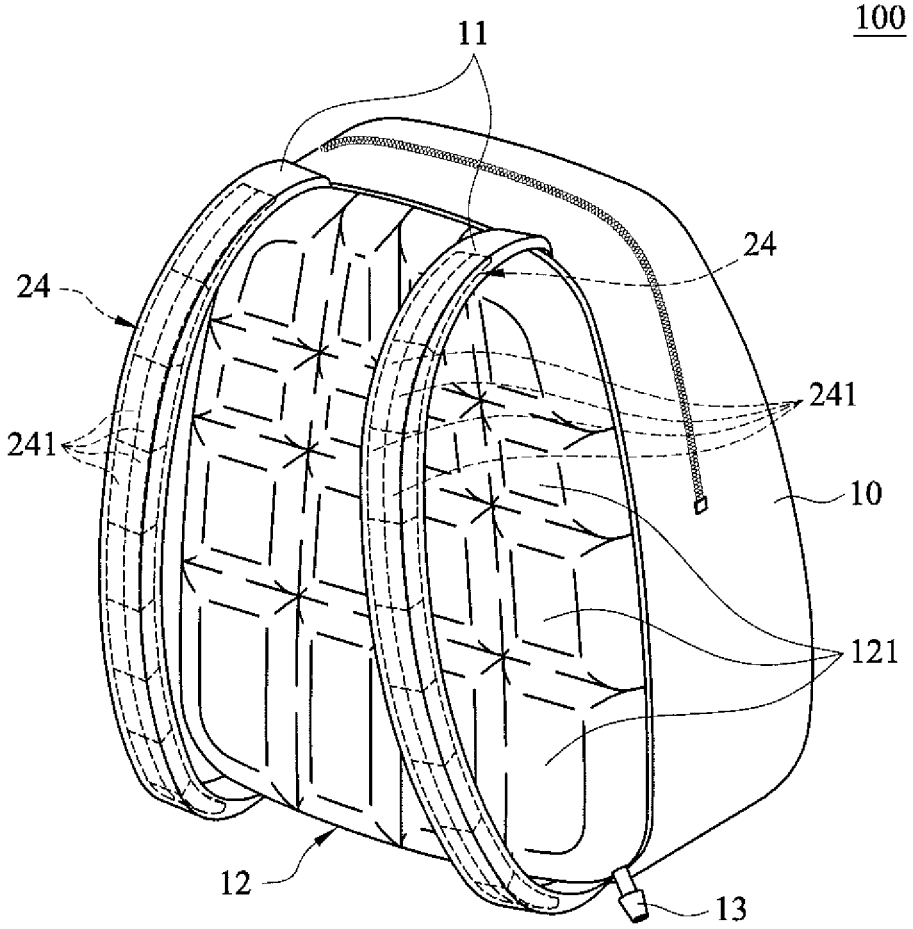
FIG. 6 is a perspective view of the backpack in still another embodiment of the present invention, wherein each strap is connected with a second airbag unit.

In the embodiment shown in FIG. 6, each strap 11 of the backpack with multiple connected airbags is provided with a second airbag unit 24 connected to the inner side of the strap, wherein each second airbag unit 24 is composed of a plurality of second airbags 241. The second airbag units 24 serve to cushion the weight-bearing portions of the user's shoulders from the load of the backpack 100 carried on the user's back and thus offer enhanced comfort.

Unlike the first airbags 121 in the first airbag unit 12, the second airbags 241 are not in communication with each other. Therefore, when the second airbags 241 in contact with the user's shoulders are subjected to a load, the air in those second airbags 241 will not be pushed into other second airbags 241, and this ensures that the cushioning ability of the former second airbags 241 will not be compromised.

In order to further reduce the burden placed by the backpack 100 on the user's shoulders, the second airbags 241 on the inner side of each strap 11 can be arranged in two adjoining rows along the strap. Thus, the width of the straps 11 and consequently the area of contact between the straps 11 and the user's shoulders will be effectively increased to disperse and reduce the pressure per unit area on the user's shoulders.

It can be known from the above that the backpacks with multiple connected airbags as disclosed in the foregoing embodiments are indeed capable of achieving the intended effects, i.e., lying compliantly against the user's back while the user is moving, allowing the heat and moisture discharged from the user's back to dissipate efficiently, providing enhanced comfort and stability when carried on the user's back, and last but not least, protecting the user's spine.

The features of the present invention are disclosed above by the preferred embodiment to allow persons skilled in the art to gain insight into the contents of the present invention and implement the present invention accordingly. The preferred embodiment of the present invention should not be interpreted as restrictive of the scope of the present invention. Hence, all equivalent modifications or amendments made to the aforesaid embodiment should fall within the scope of the appended claims.

What is claimed is:

1. A backpack with multiple connected airbags, comprising:

a backpack body having a set of straps;

a first airbag unit comprising a plurality of first airbags and connected to a rear side of the backpack body, wherein a groove and an air channel are formed between each two adjacent said first airbags, the air channels allow air in the first airbags to flow between the first airbags, and the first airbags are so arranged that each said first airbag in a peripheral region of the first airbag unit occupies a larger area on the rear side of the backpack body than any said first airbag in a central region of the first airbag unit, wherein each first air bag in the peripheral region has an edge on a periphery of the air bag unit, and each first airbag in the central region does not have an edge on the periphery of the air bag unit; and at least one air inlet in communication with at least one of the first airbags;

wherein the groove formed between each two adjacent ones of said first air bags provide a plurality of furrows in the first airbag unit.

2. The backpack of claim 1, wherein the first airbags are arranged in a two-dimensional array with a plurality of rows and a plurality of columns, each of said first airbags in the central region of the first airbag unit and along the central column occupies a smaller area on the rear side of the backpack body than any other said first airbags.

3. The backpack of claim 1, wherein the first airbag unit forms an ergonomic curve in a side view.

4. The backpack of claim 1, wherein the first airbag unit is curved in a top view.

5. The backpack of claim 1, wherein the first airbag unit is connected with a breathable and waterproof fabric serving as an outermost layer of the first airbag unit.

6. The backpack of claim 1, wherein the first airbag unit is detachably connected to the backpack body by a fastening means.

7. The backpack of claim 6, wherein the fastening means for detachably connecting the first airbag unit to the backpack body is a plurality of snap fasteners.

8. The backpack of claim 6, wherein the fastening means for detachably connecting the first airbag unit to the backpack body is at least one zipper.

9. The backpack of claim 6, wherein the fastening means for detachably connecting the first airbag unit to the backpack body is at least one Velcro fastener.

10. The backpack of claim 1, wherein each said strap has an inner side connected with a second airbag unit, and each said second airbag unit is composed of a plurality of second airbags.

11. The backpack of claim 10, wherein the second airbags of each said second airbag unit are arranged in two rows.

12. The backpack of claim 1, wherein the plurality of furrows are exposed to outside of the backpack.

13. The backpack of claim 12, wherein the first airbags are arranged in a two-dimensional array with a plurality of rows and a plurality of columns, and said first airbags at an end of each of the plurality of the rows respectively occupy a larger area on the rear side of the backpack body than any other of said first airbags on the same row.

14. The backpack of claim 13, wherein each said first airbag on a bottom of each of the plurality of the columns occupies a larger area on the rear side of the backpack body than any other of said first airbags on the same column.

15. The backpack of claim 12, wherein the first airbags are arranged in a two-dimensional array with a plurality of rows and a plurality of columns, the number of said first airbags in each of the plurality of the rows is not less than four, and the number of said first airbags in each of the plurality of the columns is not less than four.

16. A backpack with multiple connected airbags, comprising:

a backpack body having a set of straps;

a first airbag unit comprising a plurality of first airbags and connected to a rear side of the backpack body, wherein a groove and an air channel are formed between each two adjacent said first airbags, the air channels allow air in the first airbags to flow between the first airbags, and the first airbags are so arranged that each said first airbag in a peripheral region of the first airbag unit occupies a larger area on the rear side of the backpack body than any said first airbag in a central region of the first airbag unit; and at least one air inlet in communication with at least one of the first airbags;

wherein the groove formed between each two adjacent ones of said first air bags provide a plurality of furrows in the first airbag unit; and wherein the first airbags are arranged in a two-dimensional array with a plurality of rows and a plurality of columns, and said first airbags at an end of each of the plurality of the rows respectively occupies a larger area on the rear side of the backpack body than any other of said first airbags on the same row.

17. The backpack of claim 16, wherein said first airbag on the bottom of each of the plurality of the columns occupies a larger area on the rear side of the backpack body than any of said first airbags on the same column.

18. The backpack of claim 1, wherein the first airbags are arranged in a two-dimensional array with a plurality of rows and a plurality of columns, the number of said first airbags in each of the plurality of the rows is not less than four, and the number of said first airbags in each of the plurality of the columns is not less than four.

19. A backpack with multiple connected airbags, comprising:

a backpack body having a set of straps;

a first airbag unit comprising a plurality of first airbags and connected to a rear side of the backpack body, wherein a groove and an air channel are formed between each two adjacent said first airbags, the air channels allow air in the first airbags to flow between the first airbags, and the first airbags are so arranged that each said first airbag in a peripheral region of the first airbag unit occupies a larger area on the rear side of the backpack body than any said first airbag in a central region of the first airbag unit; and at least one air inlet in communication with at least one of the first airbags;

wherein the groove formed between each two adjacent ones of said first air bags provide a plurality of furrows in the first airbag unit; and wherein the first airbags are arranged in a two-dimensional array with a plurality of rows and a plurality of columns, each of said first airbags in the central region of the first airbag unit and along the central column occupies a smaller area on the rear side of the backpack body than any other said first airbags.

* * * * *